United States Patent [19]

Hausman

[11] 4,029,320

[45] June 14, 1977

[54] EDUCATIONAL GAME APPARATUS AND TEACHING SYSTEM

[76] Inventor: Jack Hausman, 18-05 215 St., Bayside, N.Y. 11360

[22] Filed: May 21, 1975

[21] Appl. No.: 579,317

[52] U.S. Cl. ..... 273/134 AD; 35/9 R; 35/69; 273/134 C; 273/134 D; 273/134 AT; 273/137 R

[51] Int. Cl.[2] ..... A63F 3/00

[58] Field of Search ..... 273/131, 134, 137; 35/9, 69

[56] References Cited

UNITED STATES PATENTS

| | | | |
|---|---|---|---|
| 925,142 | 6/1909 | Spillman | 273/134 D |
| 1,635,734 | 7/1927 | Ziegler | 273/134 AC |
| 1,903,661 | 4/1933 | Storey | 273/134 C |
| 3,104,106 | 9/1963 | Kenney et al. | 273/134 C |
| 3,815,919 | 6/1974 | Cain et al. | 273/134 AD |
| 3,939,578 | 2/1976 | Coffey | 35/9 |

FOREIGN PATENTS OR APPLICATIONS

| | | | |
|---|---|---|---|
| 825,911 | 12/1937 | France | 273/134 AF |
| 1,464,723 | 11/1966 | France | 273/134 C |

*Primary Examiner*—Delbert B. Lowe
*Attorney, Agent, or Firm*—Natter & Natter

[57] ABSTRACT

An educational game kit including a game board having a pattern of stations and associated chance controlled playing pieces which are movable over the stations along defined paths of travel. The game encompasses the selective introduction of teaching subject matter through tutorial cards which are keyed to certain of the stations. In accordance with the rules of play, when the playing piece lands on a correspondingly keyed station, a tutorial card is removed from a pack of cards, and if the information solicited by the card is correctly supplied by the participant, the playing piece may be further advanced on the game board. Movement of the playing piece is further influenced by specific written indicia contained in several of the stations. Supplemental tutorial cards for furnishing other levels and categories of teaching subject matter can be interchangeably integrated into the game procedure.

4 Claims, 7 Drawing Figures

EDUCATIONAL GAME APPARATUS AND TEACHING SYSTEM

BACKGROUND OF THE INVENTION

1. Field of the Invention

The invention relates generally to a teaching aid and especially to an educational game device and teaching system.

In particular, this invention concerns an educational game apparatus and system having a game board with movable chance controlled playing pieces and further embodying accessory cards including tutorial cards containing teaching material.

2. Description of the Prior Art

The basic teaching approach for many years past within the school systems has been almost exclusively through the use of text books; however within recent years the dominance of text books along with the traditional teaching styles and methods have been altered, and new teaching tools have been introduced. One aspect of this new pedagogic approach has been through the use of various teaching aids including cassette recorders, slide projectors, electronic calculators and other educational devices such as games.

Many of the prior art games are primarily directed to amusement or entertainment devices, with the learning aspect being incidental thereto. A typical game of this kind providing for movement of playing pieces on a game board is shown in U.S. Pat. No. 2,451,196. Other previously patented board games being more directly concerned with teaching are illustrated in U.S. Pat. Nos. 2,995,374 and 3,104,106. These last mentioned patented games are, however, limited to or otherwise lend themselves to, specific educational materials and are not adapted as a programmed teaching system.

A disadvantage of these existing educational games is that they do not provide for selective educational material to be introduced into the game procedure in harmony with specific teaching objectives. In contrast, the game of this invention provides for flexibility of subject matter by incorporating interchangeable tutorial cards which can be programmed in accordance with learning abilities.

A further shortcoming with such previously patented games is that the rules of play are frequently uninteresting and there is therefore a tendency to lose interest. Other known educational games involve game procedures that are complicated in nature and are not readily understood by young children and therefore require close supervision. The competitive aspect of the present game apparatus provides the necessary incentive and stimulus for learning. Additionally, the game rules are relatively easy to follow especially for slow learners or those who may have been educationally deprived.

It should thus be apparent that the device of this invention overcomes the disadvantages of the prior art and provides a teaching system adaptable for the classroom and useful as an educational tool in developing basic skills. This is particularly important for those in need of remedial instruction. The competitive interest generated by this game relieves the necessity for constant teacher supervision, encourages active participation and is a motivating force for learning the subject matter.

BRIEF SUMMARY OF THE INVENTION

The educational game apparatus of this invention primarily concerns a teaching aid and system, although it may find other incidental application as for general entertainment purposes. Basically, the game device is designed to encourage and stimulate the learning processes by presenting selected teaching material through a competitive game environment. The teaching system is intended for group participation and the game is thus organized in a manner to attract and hold the interest of children and to provide the necessary incentive for improving their educational skills.

The game apparatus provides a game board divided into a plurality of numbered stations and includes associated playing pieces for movement over the stations along defined paths of travel as further determined by a chance controlled device such as number cubes or dice. The game encompasses the selective introduction of teaching subject matter through tutorial cards which are placed in a pack on the game board and keyed to certain of the stations.

In accordance with the rules of play, when a playing piece lands on a designated station, a correspondingly indexed tutorial card is removed from the pack of cards. Each of the cards is designed to elicit specific information as presented in the form of a question or problem with the correct response being determinative of further advancement of the playing piece. The tutorial cards in each of the packs are preferably arranged to cover particular categories of subject matter such as arithmetic, spelling, or other such concepts wherein separate packs of tutorial cards relating to different teaching materials can be programmed and selectively introduced into the game.

Other accessory cards are included in the game procedure, and, while they are not directed to specific subject matter, they contain reading material in the form of instructions or directions and are thus used to influence movement of the playing pieces and generally to inject an added element of interest.

It should be noted that within the total concept of the invention the playing pieces are provided with distinctive indicia in the form of mathematical symbols or geometric shapes to further acquaint and familiarize the student with these functions.

Additionally, other of the stations on the board contain written indicia in the nature of a bonus or penalty provision and so affect the progress of the playing piece. Furthermore, some of the stations are connected in a manner that permits the playing piece to be shifted or to otherwise "skip" stations following an alternate path of travel.

Since the object of the game is to move the playing piece to the last numbered station or terminal point, the teaching system advantageously employs the competitive game procedure as an inducement for encouraging comprehension of the materials presented in a generally self-educational process. An inherent advantage, therefore, of this game apparatus and method is that close supervision or constant teacher presence is not required.

Another feature of this invention is the use of interchangeable tutorial cards whereby they can be arranged so that a plurality of cards having related subject matter of similar difficulty can be separately stacked in distinct packs on the board under specific headings and thus be programmed into the game procedure in accordance with the teaching objectives and the student's progress.

Having thus summarized the invention it will be seen that an object thereof is to provide an educational game apparatus of the general character described herein which is not subject to the disadvantages of the prior art.

Specifically, it is an object of the instant invention to provide an educational game apparatus as herein described for encouraging and stimulating the learning processes by presenting selected teaching cards in a competitive board game environment being suitable for the classroom.

Another object of this invention is to provide an educational game apparatus for improving learning abilities employing a game board delineating a plurality of stations and having chance controlled playing pieces competitively movable over the stations with specified stations being keyed to tutorial cards wherein the comprehension of teaching materials presented on the cards is determinative of the progressive movement of the playing pieces and serves to reinforce the teaching process.

The above and other objects, features and advantages of this invention will be apparent from the following description of the preferred embodiment when considered in connection with the accompanying drawings.

BRIEF DESCRIPTION OF THE DRAWINGS

In the accompanying drawings in which is shown a preferred embodiment of the invention.

DETAILED DESCRIPTION OF THE INVENTION

Figure 1:
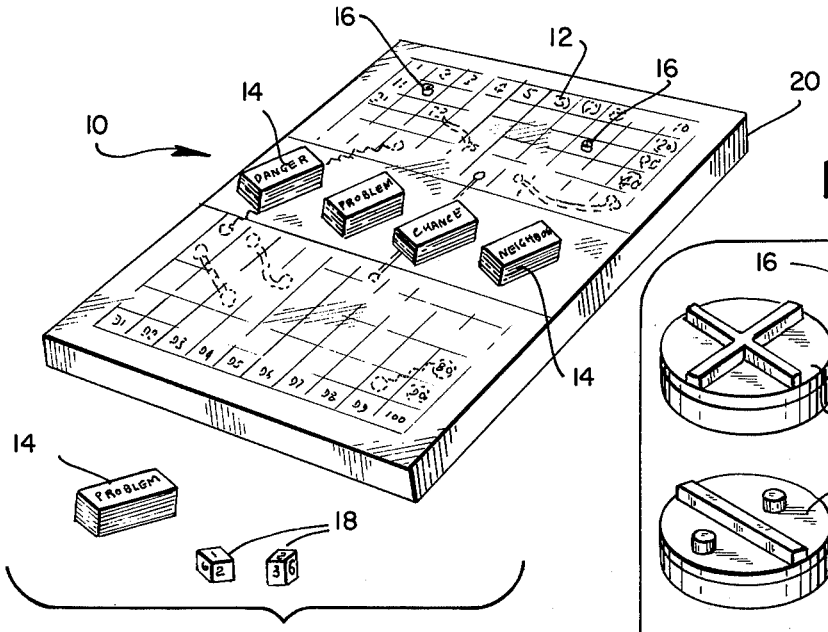
FIG. 1 is a perspective view of an educational game apparatus and illustrates a typical game board, a supplemental pack of cards, and a pair of dice adjacent the board.

Referring now in detail to the drawings, the reference numeral 10 denotes generally an educational game apparatus and teaching system of this invention. The educational game apparatus 10 as illustrated in the embodiment of FIG. 1 includes a game board 12, a plurality of accompanying accessory cards 14, a multiple of playing pieces 16, and a chance controlled device such as number cubes or dice 18. These game components are suitably contained within a box 20 which provides a convenient method for packaging the game apparatus 10 as a kit.

Figure 2:
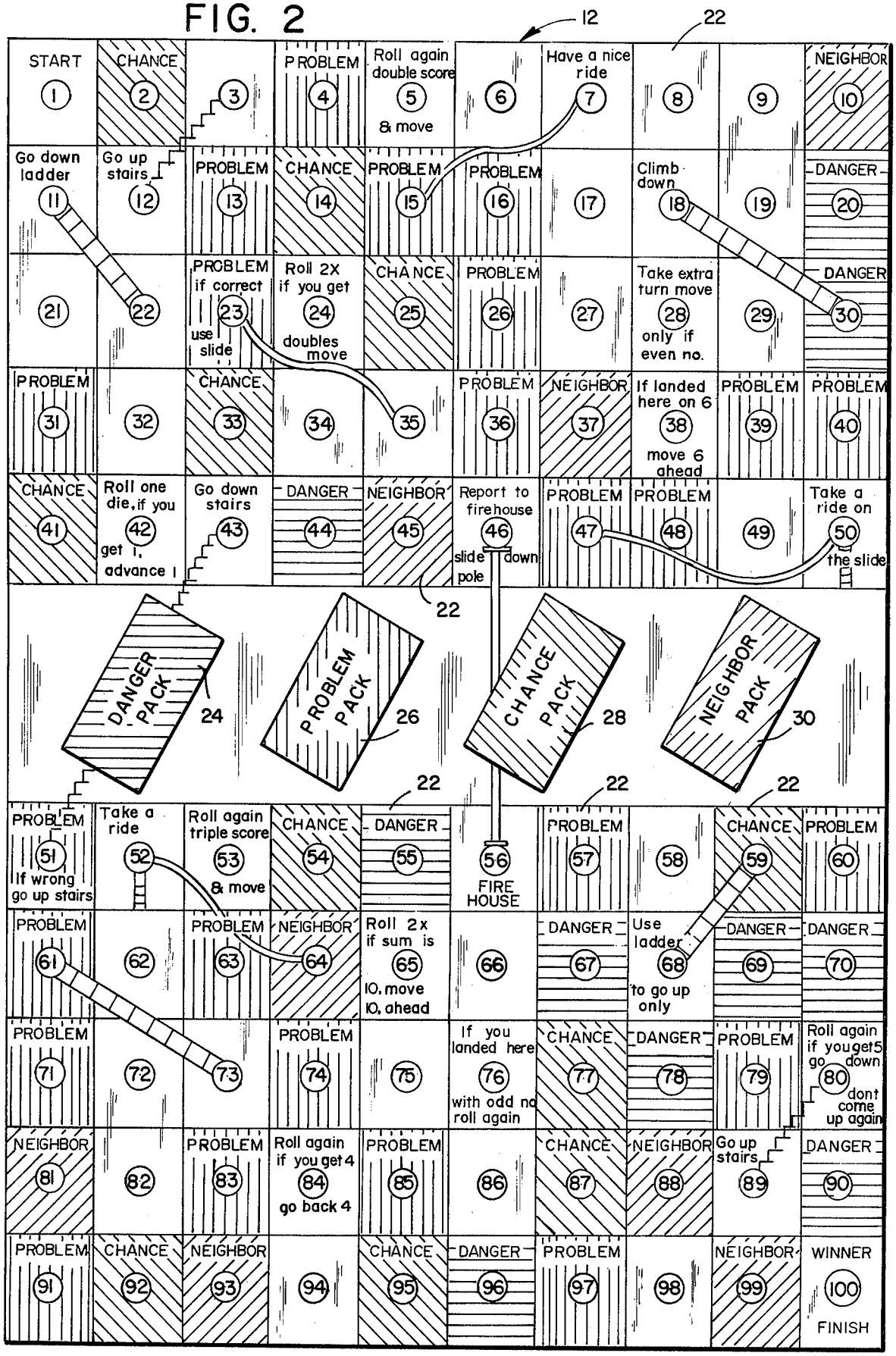
FIG. 2 is a plan view of the game board illustrating a pattern of stations numbered one through one hundred with written indicia thereon and indicating the four delineated spaces for placement of the respective packs of accessory cards.

The game board 12 is provided with a smooth planar surface having markings on one face thereof which define a plurality of uniform spaces or a network of rectangularly shaped stations 22. As shown in FIG. 2, one hundred such stations 22 are provided and consecutively numbered from 1 to 100. A median area on the board 12 has four designated spaces 24, 26, 28, 30 for indicating placement of the accessory cards 14. The respective spaces are denoted by the words "Danger Pack", "Problem Pack", "Chance Pack", and "Neighbor Pack", with each having a distinct color code. In the preferred embodiment, the representative colors as indicated by the designated draftsman's symbols are blue, red, green, and brown. Correspondingly, stations 22 such as those numbered 20, 30, 44, etc., are marked with the word Danger, stations numbered 4, 13, 15, 16, etc., contain the word Problem, stations numbered 2, 14, 25, etc., have the word Chance therein, and stations numbered 10, 37, 45, etc., are designated Neighbor stations. These stations are also color coordinated in the representative colors.

Additionally, other stations 22, such as those bearing the numbers 5, 7, 11, 12, etc., contain written indicia indicating directions affecting the movement of the playing piece 16. Furthermore, as shown, the stations bearing numbers 11 and 22 are connected, whereby a playing piece landing on station number 11 is shifted along an alternate path of travel or otherwise skipped to station number 22. Similarly, stations numbered 7 and 15, 18 and 30, 23 and 35, 43 and 51, etc., are connected and designate a particular route to be followed.

The board 12 is preferably fabricated from a stiff paper, pasteboard, cardboard, or like material, which has been laminated as with a transparent plastic film to provide a durable surface. A flexible hinge section (not shown) can also be provided transversely through the board 12 so as to permit folding for compact storage within the box 20 when not in use.

Figure 1A:
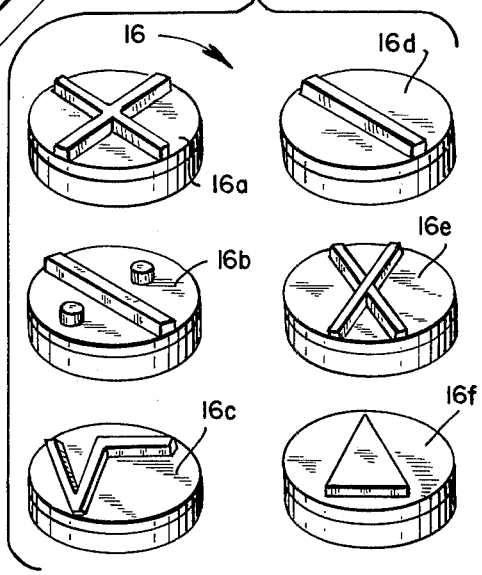
FIG. 1A is an enlarged perspective view of six typical playing pieces showing the distinctive mathematical and geometric indicia.
Figure 3:
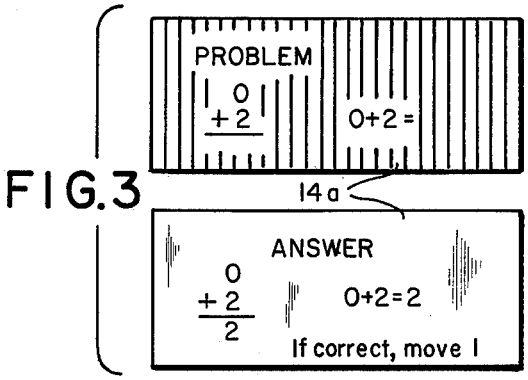
FIG. 3 is an illustration of a typical tutorial card associated with the game apparatus and designated as a "Problem"; the face of the card in this instance presents an arithmetic problem with the answer appearing on the reverse side of the card.

The playing pieces 16 are comprised of tokens being compatible in size for placement within the stations 22 and are provided with distinctive indicia. FIG. 1A illustrates six typical playing pieces **16*a*–16*f* having various mathematical symbols and a geometric shape embossed thereon or otherwise affixed thereto. In consonance with the total teaching concept, the introduction of these playing pieces 16 thus acquaints the game participant with these functions. Accordingly, an addition sign appears on piece 16*a*, a division sign on piece 16*b*, a square root symbol on piece 16*c*, a subtraction sign on piece 16*d*, a multiplication sign on piece 16*e*, and a triangle is shown on piece 16*f***. It should be apparent that other symbols can be substituted or added to the game apparatus.

The movement of the game piece 16 over the board 12 on stations 22 is determined by the throw of the dice 18 and the sum of the numbers appearing on each die.

The accessory cards 14 are separated into four stacks or packs as designated by the identifying indicia contained thereon and representative colors. For example, the typical accessory cards 14 as shown in FIGS. 3, 4, 5 and 6 bear, on their face sides, the respective titles Problem, Chance, Danger, and Neighbor and are intended for placement on the corresponding board spaces 26, 28, 24, and 30.

Certain of the accessory cards 14 such as the Problem cards 14*a* contain specific teaching materials and are referred to as tutorial cards. In this preferred embodiment the tutorial cards 14*a* contain arithmetic examples in the first decade, i.e., addition and subtraction wherein the total is between 0 and 10. In order to ascertain the correct answer and to further reinforce the learning process, the answer to the arithmetic example is indicated on the back or reverse side of the card 14*a*. Supplemental cards containing, for instance, second decade arithmetic examples, such as multiplication or division or other mathematical concepts, can be programmed into the game procedure in accordance with improved learning abilities and teaching objectives. It should also be apparent that these supplemental cards can include a wise variety of subject matter which would lend itself to such presentation, e.g., telling time, temperature, measuring, spelling, etc. Preferably the cards in each of the tutorial packs to be so substituted contain similar subject matter and correspond with respect to grade level.

Figure 5:
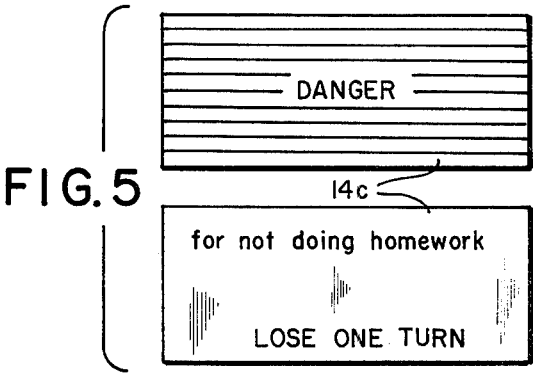
FIG. 5 is an illustration of a typical accessory card associated with the game apparatus and designated as a "Danger" card on its face; the reverse side of the card presents different instructions in the form of penalties affecting movement of the playing piece.
Figure 4:
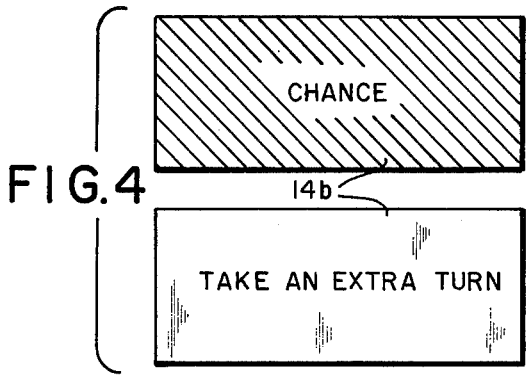
FIG. 4 is an illustration of a typical accessory card associated with the game apparatus and designated as a "Chance" card on its face side; the reverse side of the card provides specific directions for advancing or retarding movement of the playing piece.
Figure 6:
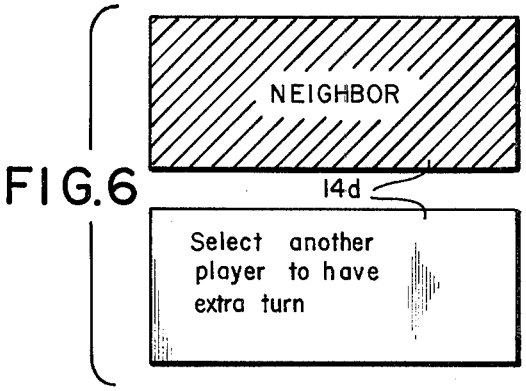
FIG. 6 is an illustration of a typical accessory card associated with the game apparatus and designated as a "Neighbor" card on its face; the reverse side of the card directs some form of interaction with another playing piece or player involved in the game.

In FIGS. 4, 5, and 6 are shown typical Chance card 14*b*, Danger card 14*c*, and Neighbor card 14*d*. Although these last mentioned cards do not introduce specific pedagogic materials, they serve a function as a mental exercise and for providing an opportunity to improve reading skills. The directions or instructions as indicated on the backs or reverse sides of these cards further add an element of excitement and interest to the game procedure.

It should be noted, however, that all or some of these last mentioned card packs can be replaced by tutorial cards bearing teaching exercises in specific subjects. The teaching system is thus flexible enough to provide for the introduction of a wide variety of learning materials through accessory cards which can be interchangeably integrated into the game.

The manner in which the game can be played is described as follows:

Any number of participants can play, but preferably three to six players is considered a desirable number and will comfortably permit the players to position themselves around the board. To start the game, each player rolls one die; the player with the highest number goes first. In the case of a tie, the players involved in the tie roll again until one player is successful. Play will then continue in a clockwise direction from the player receiving the highest number. Each player then selects, in order, a distinctive playing piece which is provided and in turn rolls a set of dice and moves his playing piece a number of stations corresponding to the number shown on the dice by starting at the upper left on the board and moving from left to right. When the playing piece is accordingly moved to a station, the player must correctly read and follow the instructions which may appear within the station. For example, depending on the particular station, the player may find the directions instructing him to "roll the dice two times; if you get doubles move that many stations", or "if you landed here with a six, move ahead six more stations", or "Roll again; if you get four, go back four stations". Additionally, certain of the stations provide for bonus or penalty movement by shifting of the playing piece between stations connected by a "ladder", "slide", "pole", or "steps". These stations have directions indicating such movement—for example, "climb down the ladder", or "take a ride on the slide".

It should be obvious that the game procedure itself would require the child participant to learn to count, to correctly add together the numbers appearing on the dice and also to accurately read and follow instructions as indicated on the board. However, as previously mentioned, an important aspect of the invention resides in the incorporation of selected teaching materials that can be contained in the four decks of cards marked Danger Pack, Problem Pack, Chance Pack, and Neighbor Pack. Since certain of the stations are keyed to these cards, when the playing piece lands on these stations, the player must remove the top card from the appropriate pack and must correctly answer or respond in order to advance his playing piece. The object of the game is to reach the last station, numbered 100, and the first player to do so is declared the winner.

The above cited embodiment is intended as exemplary, and while it has described the invention with specific implementation thereof, other modifications and changes might be made in this embodiment as so set forth and will be apparent to those skilled in the art. Furthermore, it should be understood that all material shown and described in the accompanying drawings is to be interpreted as illustrative and not in a limiting sense.

Having thus described the invention, there is claimed as new and desired to be secured by Letters Patent:

1. An educational game apparatus in kit form adaptable for use in a classroom and designed to encourage and stimulate the learning processes by presenting selected teaching materials through a competitive game environment, said game apparatus comprising a game board having thereon a pattern of stations for defining paths of travel, a plurality of distinctive playing pieces for representing each of several game participants, the playing pieces being adapted for placement on the stations, chance controlled means for determining movement of the respective playing pieces from an initial station to a final station along alternate paths of travel, with selected stations on the game board being provided with written intelligence incorporated into the game procedure for determining the progressive movement of the playing piece landing thereon, accessory cards containing directions affecting movement of the playing pieces, said accessory cards being arranged in at least two different packs and being separately identifiable under specific headings and color coded to stations on the game board bearing similar headings and representative colors, at least one of said packs of accessory cards including tutorial cards containing specific pedagogic materials of selected subject matter and learning ability level, said tutorial cards being keyed to designated stations and integrated into the game procedure such that correct responses reinforce the learning processes by providing for the advancement of the respective playing pieces toward the final station, and further including a pack of supplemental tutorial cards bearing other pedagogic material for selective introduction as by teacher monitoring in substitution of the first mentioned tutorial cards, said supplemental tutorial cards being programmed for interchangeable integration into the game procedure in accordance with the improved learning abilities and teaching objectives.

2. An educational game apparatus as claimed in claim 1 wherein selected stations on the game board are interconnected to provide an alternate path of travel for the playing piece in accordance with directions contained in the station whereby the playing piece is advanced or moved backward several stations along a prescribed route.

3. An educational game apparatus as claimed in claim 2 wherein the game board is divided into a pattern having one hundred stations consecutively numbered for defining the path of travel, said game board including a median area having color coded spaces marked for placement of the packs of accessory cards with matching representative colors.

4. An educational game apparatus as claimed in claim 1 wherein the playing pieces include tokens each having distinctive indicia expressed through mathematical symbols in relief.

* * * * *